252-99 AU 165 EX
3/2/76 OR 3,941,710

United States Patent [19]
Gilbert et al.
[11] 3,941,710
[45] Mar. 2, 1976

[54] PHOSPHATE - FREE DISHWASHING COMPOSITIONS CONTAINING AN ALKYL POLYETHER CARBOXYLATE SURFACTANT

[75] Inventors: Allan H. Gilbert, Oradell; Donald V. Kinsman, Tenafly, both of N.J.

[73] Assignee: Lever Brothers Company, New York, N.Y.

[22] Filed: May 28, 1974

[21] Appl. No.: 474,121

Related U.S. Application Data

[63] Continuation of Ser. No. 246,734, April 24, 1972, abandoned.

[52] U.S. Cl. ..... 252/99; 252/89 R; 252/135; 260/535 P

[51] Int. Cl.[2]... C11D 1/06; C11D 1/83; C11D 3/08; C11D 3/395

[58] Field of Search ..... 252/89, 99, 135; 260/535

[56] References Cited

UNITED STATES PATENTS

| | | | |
|---|---|---|---|
| 2,183,853 | 12/1939 | Haussmann | 260/535 X |
| 2,623,900 | 12/1952 | Hofer | 260/535 X |
| 2,653,972 | 9/1953 | Ash | 260/535 X |
| 2,802,715 | 8/1957 | Hofer et al. | 8/139 |
| 3,459,670 | 8/1969 | Carter | 252/99 |
| 3,630,923 | 12/1971 | Simmons | 252/99 |
| 3,692,685 | 9/1972 | Lamberti | 252/99 |
| 3,700,599 | 10/1972 | Mizuno et al. | 252/99 |
| 3,701,735 | 10/1972 | Finck | 252/99 |
| 3,741,911 | 6/1973 | Shane | 252/135 X |
| 3,819,538 | 6/1974 | Little | 252/527 |

FOREIGN PATENTS OR APPLICATIONS

| | | | |
|---|---|---|---|
| 825,649 | 10/1969 | Canada | 252/110 |

*Primary Examiner*—Dennis L. Albrecht
*Attorney, Agent, or Firm*—Kenneth F. Dusyn; James J. Farrell; Melvin H. Kurtz

[57] ABSTRACT

Low phosphate and phosphate-free automatic dishwashing compositions containing a unique surfactant system comprising an anionic polyether carboxylate surface active agent in combination with a low-sudsing nonionic surface active agent, an active chlorine compound and a silicate.

1 Claim, No Drawings

PHOSPHATE - FREE DISHWASHING COMPOSITIONS CONTAINING AN ALKYL POLYETHER CARBOXYLATE SURFACTANT

This is a continuation, of application Ser. No. 246,734, filed Apr. 24, 1972 now abandoned.

BACKGROUND OF THE INVENTION AND PRIOR ART

The present invention relates to a solid detergent composition for use in automatic or mechanical dishwashing machines.

Detergent compositions suitable for use in mechanically washing dishes, glasses, eating and cooking utensils are extremely difficult to formulate because of the many influencing factors encountered which are not encountered in providing detergent compositions for other uses.

For example, in a dishwashing machine food soil is removed in part by mechanical action and partly by physico-chemical influences. The mechanical action normally takes place when the soiled surfaces of the load are deluged with wash liquor. Among the physico-chemical factors that affect the cleaning of dishes and cutlery are wetting, emulsification, adhesion of soiled substrate, alkalinity, oxidation potential, soil suspension, anti-flocculation and foam control.

More specifically, food soil may be present in a variety of states. Some foodstuffs are oxidized, polymerized or partially decomposed by cooking, and this will affect the ease with which they may be removed. In addition, generally the main foodstuffs are proteins, phospholipids, triglycerides and carbohydrates and each of these may respond in a different way to physical and chemical conditions. Also the foodstuff may coat widely different substrates. For example, glass, glazes (plain and pigmented) present on pottery and chinaware, metals and plastics present another problem with regard to deleterious effects due to the washing ingredients.

Considering further some of the problems encountered in formulating dishwashing compositions, it is known that in all mechanical dishwashing equipment a serious problem results from "aeration" and "foaming" of the washing solution or rinsing water. The foam is produced primarily by the accumulation of protein food soils (such as egg solids and milk solids) during the various cycles as the dishes are washed. These materials have a natural tendency to foam. Also, since most dishwashing detergents are composed of inorganic alkaline salts, the fatty food soils become saponified in the hot solution and produce copious foam in the machine, even though the inorganic dishwashing detergents do not foam in themselves. The foam not only causes the machine to overflow, but cushions and impedes the mechanical operation of the machine to the extent that performance is measurably decreased.

Consequently, it is generally recognized that the high-foaming conventional anionic surfactants and those having anionic properties are not useful in detergent formulations proposed for use in automatic dishwashers and in place thereof the art has suggested the use of low-foaming nonionics.

In addition to a nonionic surfactant, detergent compositions for use in mechanical dishwashing equipment have invariably contained an alkaline sequestrant builder salt. Utilization of a strong sequestrant or chelate builder is necessary to remove hardness ions, buffer the solution at a pH conducive to good washing, and act as an anti-redeposition agent for soil. Complete, or even partial removal of this material normally results in badly spotted and filmed dishes, glasses, etc. More particularly, the detergent compositions for use in mechanical dishwashing according to the prior art contain from about 20% to 80% condensed phosphates. When used as the sole chelating agent it is necessary to use at least 40% phosphate in order to obtain efficient results, particularly with respect to preventing spotting and filming of glasses.

Of late, attempts by us and others have been made to formulate low-phosphate or phosphate-free products because of potential problems of eutrophication. It is noteworthy that all these attempts have apparently been based upon the replacement of the usual tripolyphosphate sequestrant builder with nonphosphate substitutes. Sodium nitrilotriacetate (NTA) has been an obvious choice, since it sequesters hardness ions equal to or better than the phosphates. Examples of such formulations are given in U.S. Pat. No. 3,544,473. It may be noted that the formulations of the prior art contain high levels of NTA or combinations of NTA with other sequestrant builders.

The present invention affords efficient dishwashing compositions which can be formulated without the need for a builder and particularly provides nonphosphorus formulations which are highly effective and do not present environmental problems.

SUMMARY OF THE INVENTION

It is one object of the present invention to provide detergent compositions for use in mechanical dishwashing which contain lower levels of phosphate than has heretofore been possible.

It is another object of the present invention to provide detergent compositions suitable for use in home automatic dishwashing machines which are free or substantially free of inorganic phosphates.

It is another object of the present invention to provide detergent compositions which are low foaming even in the presence of food.

Still another object of the present invention is to provide dishwashing compositions which leave the dishes, glassware and cutlery free of spots, streaks, films and residue.

Yet another object of the present invention is to provide dishwashing compositions which afford minimal attack of overglaze colors and decorations of fine china and aluminum pots.

The aforementioned objects and advantages are afforded by the detergent compositions of the invention to be described.

DESCRIPTION OF THE INVENTION

In accordance with the present invention we have surprisingly found that by employing a specific type of surfactant we have been able to obviate all or most of the usual strong alkaline builders usually present in detergent compositions designed for use in mechanical dishwashing machines.

We have found that a specific class of anionic surface active agents known in the art as polyether carboxylates are capable of obviating the need for phosphates or other alkaline chelating agents normally indicated to be necessary in formulating efficient detergent compositions for use in automatic dishwashing.

Thus according to one embodiment of the present invention is provision for detergent compositions suitable for use in mechanical dishwashing which contain less than 20% of a strong alkaline chelating agent.

According to still another embodiment of the present invention is provision of detergent compositions which are substantially free from strong sequestrating or chelating agents, and particularly inorganic phosphates.

According to one aspect, the detergent compositions of the present invention are suitably detergent compositions for use in mechanical dishwashers which have reduced phosphates or are substantially free of phosphates and comprise:

a. from about 1 to about 10% of at least one low-foaming nonionic surface active agent;

b. from about 1 to about 10% of a polyether carboxylate; and c. 80 to about 98% of a dishwashing detergent base and containing, based on the total weight of said composition, not more than 15% phosphate.

The detergent base referred to herein above and in the claims comprise the noncritical elements of the invention and include nondetergent adjuvants, usually present in a dishwashing composition adapted for use in a mechanical dishwasher. Accordingly, the base may comprise by weight from about:

a. 0–100% of a silicate;

b. 0–100% of a nonphosphate precipitant or sequestrant builder such as sodium carbonate, sodium polyacrylates, oxidized starches, trisodium citrate, sodium nitrilotriacetate, trisodium carboxymethyloxysuccinate and the like;

c. 0–14.7% (preferably 0–10% and more preferably 0–5%) of a phosphate builder such as sodium tripolyphosphate, tetrasodium pyrophosphate, potassium pyrophosphate and the like;

d. 0–100% of a substantially inert filler such as sodium sulfate, sodium chloride, sodium borate and the like;

e. 0–6% of an antifoaming agent;

f. 0–5% of a processing agent such as the usual anticaking agents such as carboxymethyl cellulose and the like;

g. 0–4% of a suspending agent such as carboxymethyl cellulose and the like;

h. 0–5% of additional optional ingredients selected from perfumes and dyes; and i. 0–5% of an oxidizing and preferably an active chlorine compound.

In a more preferred aspect, the compositions of the present invention comprise, based on the total weight of the composition, from about:

a. 1% to about 10% (preferably 2–4%) of a polyether carboxylate surface active agent;

b. .05% to about 2% (preferably 0.5–1.5%) of an active chlorine-containing compound;

c. 1% to about 10% (preferably 4–6%) of a low-foaming nonionic surface active agent;

d. 0.005% to about 6% (preferably 0.01–1.0%) of a defoaming agent;

e. 5% to about 97.5% (preferably 5–30% and more preferably 10–25%) of a silicate;

f. the balance comprising a filler;

g. 0–4% (preferably 2%) of a suspending agent;

h. 0–5% of an inert ingredient selected from perfumes and dyes; and containing not more than 15% (preferably 0–10%, more preferably 0–10%, and still more preferably 0%) phosphates.

Of the aforementioned ingredients those designated as (a), (b), (c) and (e) are ingredients preferably present in the compositions of the present invention. It will also be appreciated that with the exception of ingredient (a), the polyether carboxylate, the remaining elements are conventionally used in the dishwashing art.

Considering the components of the composition set forth above, the polyether carboxylates are a class of surfactants that exhibit both anionic and nonionic properties and have the following general formula:

FORMULA I $$R\text{-}(CR_1H\text{-}CH_2O)_x(CR_2R_3)_yCOOM$$

wherein

R represents 1. hydroxy;
2. a primary secondary or tertiary alkyloxy group containing 1 to about 22 (preferably 12–18) carbons in the alkyl chain and preferably a primary alkyl group;
3. an acyloxy moiety containing 2 to about 22 (preferably 12–18) carbon atoms;
4. a mono- or dihydroxyalkyloxy group containing 2 to 22 (preferably 12 to 18) carbons in the alkyl chain;
5. a mono- or dihydroxyacyloxy moiety containing 2 to about 22 (preferably 12 to 18) carbon atoms;
6. an alkoxyalkyleneoxy, phenoxyphenyleneoxy or alkoxy phenyl substituted ethoxy moiety, said alkyl groups containing about 1 to about 22 (preferably 12 to 18) carbon atoms;
7. an aryloxy moiety such as
8. alkyl substituted aryloxy moiety wherein the alkyl group has about 1 to about 20 (preferably 8 to about 18) carbon atoms such as benzyloxy;
9. aryl substituted aryloxy moiety such as biphenyloxy;
10. bi- or polycyclic aryloxy such as naphthyloxy;
11. a monocyclic cycloalkyloxy moiety containing about 5 to about 8 carbons such as cyclopentyloxy, cyclohexyloxy or cyclooctyloxy;
12. an oxygen-linked acyclic nitrogen containing a moiety selected from the group consisting of:
    a. alkyl bis(polyethenoxy) amino moieties having the general formula:

$$R'\text{—}N = \begin{matrix}(CH_2CH_2O)_{x'}\\(CH_2CH_2O)_{y'}\end{matrix}$$

wherein R′ is an alkyl group of 12–18 carbons and x′+y′ is 2–50;

b. a dialkyl bis(polyetheneoxy) quaternary ammonium moiety having the following formula:

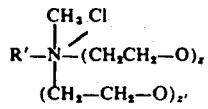

wherein R′ is an alkyl group of 12 to 18 carbons and z+z′ is about 2–15;

c. a alkyl bis(ethenoxy) amine oxide moiety of the formula:

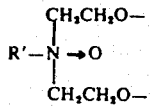

wherein

R′ is 12 to 18 carbon atoms; and 13. an oxygen-linked monocyclic or bicyclic heterocycle containing N, O or S containing 2 to 20 carbons total, such as furyloxy, tetrahydroxyfuryloxy, pyrrollyloxy, pyrrolidinyloxy, piperidinyloxy, pyridinyloxy, tetrahydropyronyloxy, thiofuryloxy, thiopyronyloxy, benzofuryloxy, quinolyloxy, carbazolyloxy, acridinyloxy and quinoxalyloxy; and wherein $R_1$ is hydrogen or a methyl or ethyl group;

$R_2$ and $R_3$ are hydrogen, alkyl containing 1 to about 5 carbons (preferably 1–3 carbons), carboxyl or carboxyalkyl containing a total of 2–4 carbon atoms;

$x$ is 1 to 50 (preferably 2–30 and more preferably 10–20);

$y$ is 1 to 3 when $R_2$ and $R_3$ are hydrogen and $y$ is 1 when either $R_2$ or $R_3$ is other than hydrogen; and M is an alkali metal cation.

In addition to specific polyether carboxylates falling within the scope of Formula I, it will be appreciated that when R of Formula I contains a functional group with a replaceable hydrogen (i.e., mono- or dihydroxyl, carboxyl, mono- or dihydroxylacyl) said hydrogen(s) may be replaced by 1–3 additional $(CR_1H\text{-}CH_2O)_x(CR_2R_3)_yCOOM$ moieties.

From the aforementioned list, those skilled in the art will now realize that a wide variety of polyether carboxylates are suitable for use in accordance with the present invention. As far as we are able to determine, all of the compounds disclosed above are equivalent for purposes of the use disclosed herein. Of course, from the standpoint of economy and ease of preparation certain of the polyether carboxylates are naturally preferred. For example, the polyether carboxylates of Formula I which are particularly useful are those wherein R is:

a. an alkoxy group;
b. an acyloxy moiety;
c. a mono- or dihydroxy straight-chain alkoxy moiety wherein the hydroxy group(s) may be attached to any carbon on the chain;
d. a phenoxy moiety;
e. alkylphenoxy such as nonylphenoxy; and
f. an acyclic nitrogen containing moiety.

In the preferred embodiment of the present invention it is desirable to use polyether carboxylates of Formula 1 wherein R is an alkoxy group and preferably one containing a straight chain of 12–18 carbons and more preferably 12–15 and still more preferably 14–15 carbons and $x$ is preferably 10 to 20.

The polyether carboxylates of the present invention individually and as a class are for the most part well known; and although certain representative members have been employed as ingredients in laundry detergents, lubricating greases and to render textiles more receptive to bleaches and dyes, the use thereof has never been suggested in a formulated dishwashing composition for use in automatic machines. In fact it is surprising in view of the anionic character and the other critical demands required that the polyether carboxylates may be so utilized.

It is even more surprising that by employing polyether carboxylates it is possible to reduce the phosphate content to levels lower than heretofore possible when phosphates are used as the sole builder or when used in combination with other builders. As previously stated, it is even possible to formulate a detergent composition which is efficient for use in mechanical dishwashing wherein the traditional builders are completely absent.

The nonionics, which also form a critical part of the present invention, are those surface active agents which:

1. are low foaming and/or
2. are capable of defoaming food soils such as milk or at least not influenced by the presence of food.

Specifically, the low-sudsing nonionic surface active agents used in conjunction with the polyether carboxylates in accordance with the present invention are well known. For example some of the better known ones are the "Pluronic" series of ethylene oxide-propylene oxide block polymers, the alkylaryl polyethers such as "Triton CF-10" and amine polyglycol condensates such as "Triton CF-32".

Accordingly one class of low-foaming nonionic surface active agents usable in the present invention may be described as polyoxyalkylene adducts of hydrophobic bases wherein the oxygen/carbon atom ratio in the oxyalkylene portion of the molecule is at least 0.5. More specifically, the nonionics are those adducts resulting from the condensation of ethylene oxide, butadiene oxide, glycidol or polyoxypropylene with such hydrophobic bases as mono- and polyalkyl phenols, fatty acids, fatty amines, fatty amides, alkyl mercaptans and fatty alcohols.

Another class of suitable low-foaming nonionics are cogeneric mixtures of conjugated polyoxyalkylene compounds containing in their structure at least one hydrophobic oxyalkylene chain in which the oxygen/carbon atom ratio does not exceed about 0.33 and at least one hydrophobic oxyalkylene chain in which the oxygen/carbon atom ratio is not less than about 0.5. The aforementioned conjugated polyoxyalkylene compounds particularly useful in the present invention correspond to the following general formulae.

FORMULA II $$R\text{—}(C_3H_6O)_n(C_2H_4O)_mH$$

wherein R is an organic radical having 1–7 carbons and one reactive hydrogen; $n$ has an average value of at least 6; and m has a value such that the oxyethylene portion constitutes about 10–90% of the molecule. Surface active agents falling within this description are described in U.S. Pat. No. 2,677,700 and generally known as the "Pluronic" series;

FORMULA III $$R\text{—}[(C_3H_6O)_n(C_2H_4O)_mH]$$

wherein R is an organic radical having from 2–6 carbons containing at least 2 reactive hydrogens; $n$ has a value such that the molecular weight of the polyoxypropylene portion is at 900; $m$ is as stated for Formula II above; and $x$ has a value of at least 2. Thus R in Formulae I and II above may include for example, propylene glycol, glycerine, pentaerythritol, ethylenediamine, triethylenetetraamine, butylamine, etc. Where R is ethylenediamine, the nonionics are known as the "Tetronic" series. Compounds falling within Formulae II and III are further described in U.S. Pat. No. 2,674,619 and 2,979,528.

Other suitable low-foaming nonionics include ethylene oxide and/or propylene oxide adducts of higher alcohols having from 8–22 carbons in the aliphatic portion and about 3–30 ethenoxy or propenoxy units in the oxyalkylene portion; and polyoxyalkylene surface action agents having heteric polyoxyethylene solubilizing chains more specifically described in U.S. Pat. No. 3,101,374.

All of the aforementioned nonionics containing a hydroxyl group can be reacted with chloroacetic acid to form the polyether carboxylates of Formula I. Of course it will be appreciated that since the polyether carboxylates are derived from nonionics, the commercial form thereof may contain small amounts of unreacted nonionic. The presence of this so-called impurity however in no way affects the performance of the compositions of the present invention.

The chlorinating agents which are necessary in the compositions are the conventional organic active chlorine-containing compounds capable of liberating chlorine when solution of the detergent composition is effected in use. Active chlorine-containing compounds include:

trichlorocyanuric acid
sodium and potassium salts of dichlorocyanuric acid
1,3-dichloro-5,5-dimethylhydantion
N,N'-dichlorobenzoylene urea
N-chloroammeline
N,N'-dichloroazodicarbonamide
N-chloroacetyl urea
chlorinated trisodium phosphate
N,N'-dichlorobiuret
chlorinated dicyandiamide
dichloroglycoluril
N-chloromalonamide
N-chloromelamine (tri- and hexachloro)
N-chloronaphthalamide
N-chlorosuccinimide
P-toluenesulfonchloramide - (Na and K salts)
benzene sulfonchloramide - (Na and K salts)
N,N'-dichloro-p-toluenesulfonchloramide The preferred active chlorine compounds usable in the present invention are the alkali metal (Na and K) dichlorocyanurates and the isomeric forms thereof. It must be appreciated however that the exact type of chlorinating agent is not critical to the invention and the aforementioned list is only illustrative of a few that may be employed.

The silicates employed in the compositions of the present invention are those conventionally used in automatic dishwashing formulations. For example typical alkali metal silicates are those particulate silicates which are anhydrous or which contain waters of hydration. These include anhydrous sodium metasilicate and "GD Silicate" which are products having a $Na_2O$ $SiO_2$ ratio of 1:1 and 1:2 respectively and typically available in the form containing bound water in the amount of about 18%. In general the silicates of the present invention will have a $Na_2O:SiO_2$ ratio of 1:1 to about 1:3.75, preferably 1:2 to 1:3.75 and more preferably 1:2 to 1:2.4. These ratios may be obtained with single silicates or combinations of silicates. Ratios below 1:3.75 (i.e., 1:4) dissolve too slowly and are not normally effective and ratios of 2:1 (i.e., orthosilicate) like NaOH are too alkaline for use in the present invention. The exact amount of silicate present in the compositions of the present invention will vary between 5% to about 97.5% depending on the particular silicate and its $Na_2O:SiO_2$ ratio, the pH desired in the final composition, and its intended function in the composition. For example, in addition to regulating pH, the silicate may also serve as a filler in which case a less alkaline silicate will be used (i.e., $Na_2O:SiO_2$ ratio 1:2).

The defoaming agents used in the present invention may be any of the conventional agents commonly employed to control foaming of nonionic-based detergent formulations such as a long chain alcohol or a mono- or dialkyl phosphate, or a long chain fatty acid.

The defoaming alcohols are suitable the higher aliphatic alcohols of at least 10 to about 22 carbon atoms. The alcohols may be of the primary, secondary or tertiary type. These aliphatic alcohols may be saturated or unsaturated in character. It is preferred to use the normal or straight chain, saturated primary alcohols. Examples of suitable alcohols falling within this preferred classification are dodecanol, tetradecanol, hexadecanol and octadecanol. It is also within the contemplation of the present invention to employ unsaturated higher aliphatic alcohols (e.g., oleyl alcohol), branched chain and secondary higher aliphatic alcohols, and higher aliphatic diols. It is not necessary to use the pure substances themselves as the commercial mixtures of these substances are also operable and are preferred from the viewpoint of economy. Thus, commercial mixtures of fatty alcohols containing predominantly the alcohols of 12–18 carbon atoms are included within the scope of this invention, even though such mixtures may contain minor amounts of fatty alcohols of different chain lengths.

The preferred defoamers however are the monoalkyl or dialkyl phophate esters wherein the alkyl moieties are saturated or unsaturated, straight or branched chains containing from 16–20 carbon atoms and the alkali metal salts thereof. Suitable examples of the alkyl phosphate esters are:

monopalmityl acid phosphate
dipalmityl acid phosphate
monostearyl acid phosphate
distearyl acid phosphate
monoarchidyl acid phosphate
diarachidyl acid phosphate
monooleyl acid phosphate
dioleyl acid phosphate of which monostearyl acid phosphate is most preferred.

Another class of defoamers found particularly useful in the present invention are free fatty acids such as stearic and palmitic acids and preferably mixtures thereof, the relative proportions are such that they are sufficient to form an eutectic mixture.

The fillers used in the present invention are as a rule inert substances or salts such as sodium sulfate, sodium chloride if sodium silicate is present, sodium bicarbonate, sodium sesquicarbonate, borax, as well as many others known and conventionally used in the art. The particular filler is not critical to the invention. Ordinarily the filler may be present in an amount ranging from 30% to about 97.5% and thus may constitute a minor or major proportion of a product suitable for commercial use.

The suspending agents which may be optionally incorporated in the compositions of the present invention are polymeric materials of the type generally used as antiredeposition agents in laundry detergents. These include:

a. carboxymethyl cellulose;
b. poly(methylvinylether/maleic anhydride) copolymers;
c. ethylene/maleic anhydride resins such as linear and cross-linked ethylene/maleic anhydride copolymers;
d. polyvinylpyrolidine;
e. polyvinyl alcohol;
f. polyacrylates; and
g. polymaleates.

In addition to the polymeric compounds, other suspending agents may include those compounds used as lime soap dispersants, particularly semi-polar compounds such as dodecylmethyl sulfoxide. Another class of suspending agents are the anionic or cationic exchange resins.

To further illustrate the invention, dishwasher detergent compositions were prepared containing the polyether carboxylates of the present invention and tested in a home dishwasher under soil conditions simulated to match those encountered in home use. The test was designed to show spotting and film build-up on glass tumblers when washing was effected using moderately hard (about 110 ppm) and very hard (240 ppm) water. Depending on the quantity and quality of spotting and degree of filming the formulations were judged to be acceptable (A) or unsatisfactory (U).

Tables 1 to 4 illustrate the results obtained when typical phosphate-containing detergents and detergent compositions of the invention were tested according to the method described above. All formulations of the present invention were equal to and in many cases superior with respect to filming and spotting to similarly constituted nonphosphate compositions as well as standard phosphate-containing formulations of commerce. All parts, percentages and ratios used in the specification and claims are by weight unless otherwise indicated.

More specifically, Table 1 demonstrates that a small amount of a polyether carboxylate (Compositions C and E) can effectively obviate the need for 40% tripolyphosphate in dishwashing compositions (A and D) containing nonionic surface active agents and further demonstrates the unacceptability of a similarly formulated nonphosphate composition (B and F).

Table 2 demonstrates the superiority of a nonphosphate composition containing 5% polyether carboxylate in combination with two nonionic actives (C) over a similarly formulated nonphosphate composition (B).

Table 3 demonstrates that in addition to a polyether carboxylate, compositions of the present invention also require at least one nonionic surface active agent in combination therewith.

Table 4 illustrates the invention with respect to the variety of polyether carboxylates falling within the scope of Formula I as well as a variety of nonionics usable therewith.

TABLE 1

| Composition | A | B | C | D | E | F |
|---|---|---|---|---|---|---|
| TPP[1] | 40.00 | — | — | 40.00 | — | — |
| Polyether Carboxylate[2] | — | — | 3.60 | — | 3.96 | — |
| Silicate 1:2.4 | 30.00 | 30.00 | 30.00 | 30.00 | 30.00 | 30.00 |
| Filler[3] | 22.05 | 62.05 | 58.45 | 22.45 | 58.49 | 62.45 |
| Nonionic[4] | 0.40 | 0.40 | 0.40 | 6.00 | 6.00 | 6.00 |
| Nonionic[5] | 6.00 | 6.00 | 6.00 | — | — | — |
| Defoamer[6] | 0.05 | 0.05 | 0.05 | 0.05 | 0.05 | 0.005 |
| Active Chlorine Compound[7] | 1.50 | 1.50 | 1.50 | 1.50 | 1.50 | 1.50 |
| | ← | | | 100% | | → |
| Results (A = acceptable, B = unacceptable) | A | U | A | A | A | U |

[1]Tripolyphosphate (Na)
[2]Based on $C_{14}$–$C_{18}$ alcohol mixture condensed with 13.5 moles EO added $(CH_3(CH_2)_{12,13}CH_2O(CH_2CH_2O)_{12-14}CH_2COONa$
[3]Sodium sulfate
[4]$CH_3(CH_2)_{12,13}CH_2$—$O(CH_2CH_2$—$O)_{12.8}H$ (10% EO)
[5]Polyoxyethylene-polypropylene condensate MW-1750
[6]Monostearyl acid phosphate
[7]Dichlorocyanurate

TABLE 2

| Composition | A | B |
|---|---|---|
| TPP | — | — |
| Polyether Carboxylate[2] | — | 5.00[1] |
| Silicate | 30.00 | 30.00 |
| Filler ($Na_2SO_4$) | 62.50 | 58.25 |
| Nonionic[3] | 4.00 | 3.50 |
| Nonionic[4] | 2.00 | 1.75 |
| Active $Cl_2$ Compound | 1.50 | 1.50 |
| | ← 100% | → |
| Results (A = acceptable, U = unacceptable) | U | A |

[1]85% polyether carboxylate + 15% unreacted nonionic
[2]Same as Table 1
[3]Polyoxyethylene-polypropylene condensate containing 20% ethylene oxide
[4]Polyoxyethylene-polypropylene condensate containing 10% ethylene oxide

TABLE 3

| Composition | A | B |
|---|---|---|
| Polyether Carboxylate[1] | 5.0 | 10.0 |
| Na Metasilicate | 15.0 | 15.0 |
| Filler ($Na_2SO_4$) | 72.5 | 73.5 |
| Nonionic[2] | 6.0 | — |
| Active $Cl_2$ Compound | 1.5 | 1.5 |
| | ← 100% | → |
| Results | S | U |

[1]$CH_3(CH_2)_{12,13}CH_2O(CH_2CH_2O)_{11}CH_2COONa$
[2]Polyoxyethylene-polypropylene condensate containing 10% ethylene oxide

TABLE 4

| Composition | A | B | C | D | E | F | G | H | I |
|---|---|---|---|---|---|---|---|---|---|
| Polyether Carboxylate[1] | 5.0 | | | | | | | 5.0 | 5.0 |
| Polyether Carboxylate[2] | | 5.0 | | | | | | | |
| Polyether Carboxylate[3] | | | 5.0 | | | | | | |
| Polyether Carboxylate[4] | | | | 5.0 | | | | | |
| Polyether Carboxylate[5] | | | | | 5.0 | | | | |
| Polyether Carboxylate[6] | | | | | | 6.0 | | | |
| Polyether Carboxylate[7] | | | | | | | 6.0 | | |
| Polyether Carboxylate[8] | | | | | | | | 5.0 | 5.0 |
| Sodium Metasilicate | 15.0 | 15.0 | 15.0 | 15.0 | 15.0 | | | | |
| G.D. Silicate | | | | | | 15.0 | 30.0 | 30.0 | 30.0 |
| Hydrous Polysilicate | | | | | | 20.0 | | | |
| Sodium Sulfate | 72.5 | 72.5 | 72.5 | 72.5 | 72.5 | 55.45 | 57.45 | 55.50 | 55.50 |
| Grantez Resin[9] | | | | | | 2.0 | 2.0 | 2.0 | 2.0 |
| Nonionic[10] | 6.0 | 6.0 | 6.0 | 6.0 | 6.0 | 4.0 | 4.0 | | |
| Nonionic[11] | | | | | | 2.0 | 2.0 | | |
| Nonionic[12] | | | | | | | | 6.0 | |
| Nonionic[13] | | | | | | | | | 6.0 |
| Active Chlorine Compound | 1.5 | 1.5 | 1.5 | 1.5 | 1.5 | 1.5 | 1.5 | 1.5 | 1.5 |
| Miscellaneous | | | | | | 3.0 | 3.0 | | |
| | ← | | | | 100% | | | | → |
| Results | A | A | A | A | A | A | A | A | A |

[1]Derived from mixed $C_{16}$–$C_{18}$ sec. alcohol + 50% EO
[2]Derived from mixed $C_{16}$–$C_{18}$ sec. alcohol + 30% EO
[3]Derived from mixed $C_{12}$–$C_{14}$ sec. alcohol + 40% EO
[4]Derived from mixed $C_{11}$–$C_{15}$ sec. alcohol + 12% EO
[5]Derived from st. chain $C_{14}$–$C_{16}$ ethoxylated alcohol + 3% EO
[6]Derived from ethoxylated tridecyl alcohol
[7]Derived from mixture of $C_{11}$–$C_{15}$ sec. alcohols condensed with an average of 9 molar proportions of ethylene oxide
[8]Derived from $C_{14}$–$C_{15}$ alcohol condensed with 13.5 molar proportions of ethylene oxide
[9]A linear copolymer of maleic anhydride and methylvinylether
[10]Polyoxyethylene-polypropylene condensate containing 10% EO (nonionic)
[11]Polyoxyethylene-polypropylene condensate containing 20% EO (nonionic)
[12]$C_{14}$–$C_{15}$ alcohol condensed with 13.5 moles ethylene oxide (nonionic)
[13]A mixture of $C_{11}$–$C_{15}$ sec. alcohols condensed with an average of 5 moles of ethylene oxide

What is claimed is:

1. A nonphosphate detergent composition suitable for use in mechanical dishwashing consisting of:

a. 2 percent to about 6 percent of a polyether carboxylate based on a $C_{14}$–$C_{15}$ alcohol mixture condensed with 13.5 moles of ethylene oxide;

b. 20 percent to about 35% of a silicate having a $Na_2:SiO_2$ ratio of between about 1:2 to about 1:24;

c. 2% to about 6% of a low-foaming nonionic surface active agent;

d. 0.5% to about 1.5% of an anti-foaming agent selected from the group consisting of monostearyl acid phosphate and a eutectic mixture of stearic acid and palmitic acid;

e. 1 percent to about 2 percent of dichlorocyanurate, and f. the balance comprising filler.

* * * * *